United States Patent [19]

McCleskey, Jr. et al.

[11] 4,117,941

[45] Oct. 3, 1978

[54] DEVICE FOR HANDLING AND RACKING RISER PIPES AND DRILL PIPES

[75] Inventors: Robert W. McCleskey, Jr.; Paul S. Putnam; Arne Martin Boltad, all of Oslo, Norway

[73] Assignee: Golar-Nor Offshore A/S, Oslo, Norway

[21] Appl. No.: 781,482

[22] Filed: Mar. 25, 1977

[30] Foreign Application Priority Data

Apr. 1, 1976 [NO] Norway ..... 761124

[51] Int. Cl.[2] ..... E21B 19/14

[52] U.S. Cl. ..... 214/2.5; 175/85; 214/1 P; 214/12; 114/265

[58] Field of Search ..... 214/2.5, 1 P, 1 R, 1 BB, 214/12, 13; 175/52, 85; 294/90; 114/264, 265; 211/60 S

[56] References Cited

U.S. PATENT DOCUMENTS

| | | | |
|---|---|---|---|
| 2,773,605 | 12/1956 | De Jarnett | 214/2.5 |
| 3,371,728 | 3/1968 | Crooke et al. | 175/85 |
| 3,633,767 | 1/1972 | Mitchell et al. | 214/2.5 |
| 3,800,962 | 4/1974 | Ham | 214/2.5 |
| 3,840,128 | 10/1974 | Swoboda, Jr. et al. | 214/2.5 X |
| 3,921,823 | 11/1975 | Bourree et al. | 214/2.5 |
| 3,987,910 | 10/1976 | Brunato | 175/85 X |

*Primary Examiner*—Frank E. Werner

*Attorney, Agent, or Firm*—Burns, Doane, Swecker & Mathis

[57] ABSTRACT

Handling and racking of riser pipes in a drilling derrick on a platform by means of manipulators. The pipes are racked vertically on a set back platform and are displaced to and from a position above the rotary table by manipulators.

13 Claims, 12 Drawing Figures

DEVICE FOR HANDLING AND RACKING RISER PIPES AND DRILL PIPES

BACKGROUND

The invention relates to a device for handling and racking riser pipes in a drilling derrick on a platform for drilling and/or production of oil wells on the bottom of the sea, which platform/drilling derrick comprises a drilling floor and a cellar deck.

When drilling a well from a platform, a base is set down on the bottom of the sea. The well is then drilled through this base. A string of casing is led through the base and down into the well, and cement is pumped around this casing, so that a pile is formed for the base. A blow-out preventer, commonly called a B.O.P., is put down on top of the casing in the well. From the blow-out preventer and to the platform is used a riser pipe, with internal dimensions large enough that all the following drill pipes can be lead down. Use of riser pipes and appurtenances are well known.

A great need exists to be able to handle the riser pipes and to run them as quickly as possible. The invention aims therefore especially at providing a device which makes possible rapid handling and racking of riser pipes in a drilling derrick on a platform.

In this connection it may be an advantage to change somewhat the method used for handling and racking drill pipes and collars, subsequently termed as a whole, drill pipes, and the invention relates therefore also to a device for handling and racking drill pipes in a drilling derrick on a platform.

OBJECTS AND SUMMARY OF THE INVENTION

According to the invention, the aim is to store or rack a number of riser pipe stands of approximately 30 m, i.e. that groups of three pipes arepipe stands vertically in the drilling derrick, and an especial aim of the invention is to continue the possibility of such racking of drill pipe stands in the drilling derrick, at the same time as a vertical racking of riser pipe stands is also made possible in the drilling derrick. It is therefore an advantage according to the invention to rack the riser pipe stands in such a way that they rest on a set back platform on the cellar deck. In set back position the riser pipe stands will then be under the so-called monkey board. The monkey board is shaped in such a way that it covers the set back area for the riser pipe stands, and on each side of the monkey board are placed finger-boards in the drilling derrick, for taking up and securing the stands of drill pipes which are racked in the drilling derrick. These drill pipe stands rest on a set back platform on the drill floor.

For handling the riser pipes an elevator is used which is present in the drilling derrick and there are, moreover, according to the invention manipulators which can effect the desired displacement of taking up and securing the stands of drill pipes which are racked in the drilling derrick. These drill pipe stands rest on a set back platform on the drill floor.

For handling the riser pipes an elevator is used which is present in the drilling derrick and there are, moreover, according to the invention manipulators which can effect the desired displacement of the riser pipe stands from a central position in the drilling derrick, i.e. over the rotary table, over to a set back position and back again.

According to the invention there is in this manner provided a device for handling and racking riser pipes in a drilling derrick on a platform for drilling and/or production of oil wells on the bottom of the sea, said platform/drilling derrick comprising a drill floor and a cellar deck, and that which characterizes the device according to the invention is that it comprises a set back platform on the cellar deck for vertical storage or racking of riser pipe stands in the drilling derrick, a first manipulator for displacement of the lower end of a riser pipe stand between a first position near the center line of the drilling derrick and a second position outside the centre line, a second manipulator for the displacement of the lower end of the riser pipe stand between the above mentioned second position and a position above the set back position on the cellar deck, an elevator in the drilling derrick for lifting and lowering the riser pipe stand, a finger board in the drilling derrick intended for taking up handling subs on the riser pipe stands, locking members on the finger board for securing the handling subs in the finger board, a third manipulator for guiding and moving a handling sub between a position near the center line of the drilling derrick, in which position the handling sub can be coupled with the elevator, and a set back position in the finger board.

As mentioned already, there is also provided a device for handling and racking drill pipes in connection with the new racking of riser pipe stands in the drilling derrick, and the device for handling and racking of drill pipe stands in the drilling derrick is characterized in that it comprises a first manipulator for displacement of the lower end of a drill pipe stand between a first position near the centre line of the drilling derrick and a position above a set back position on the drill floor, an elevator in the drilling derrick for raising and lowering stands of drill pipes, a drill pipe finger board for catching up upper ends of the stands on drillpipes, locking members on the drill pipe finger board for securing the stands of drill pipes in the drill-pipe finger board, and a derrick manipulator for gripping and moving a drill-pipe's upper end between a position near the centre line of the drilling derrick, in which position the drill pipe stand can be coupled together with the elevator, and a set back position in the drill pipe finger board.

Additional features will appear in the claims. The invention will be described more in detail in the following with reference to the drawings.

THE DRAWINGS

Figure 5:
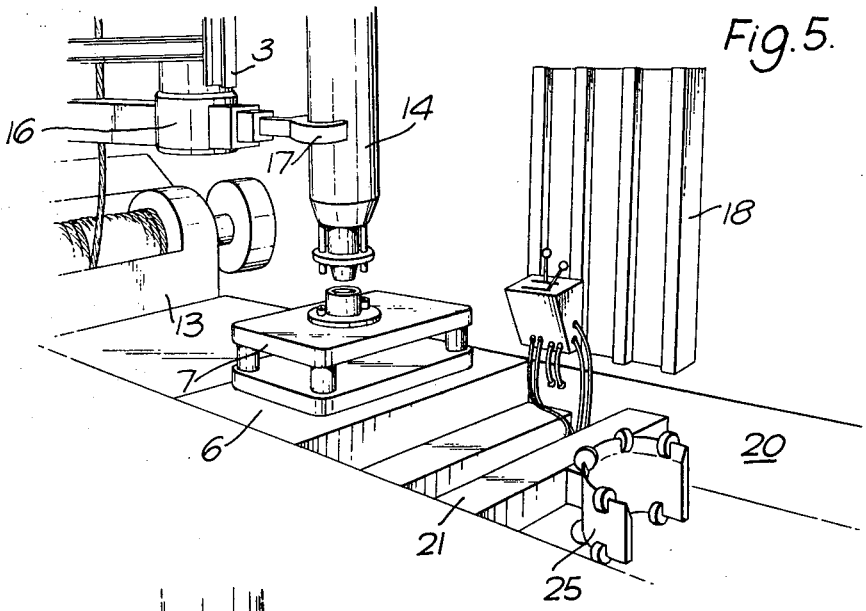
Figure 6:
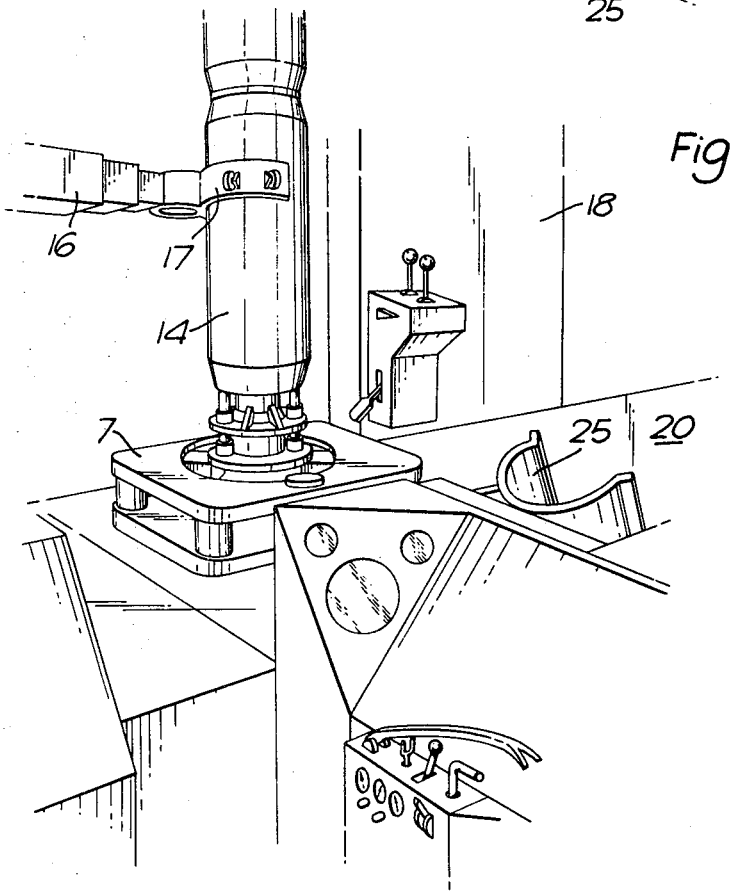
Figure 7:
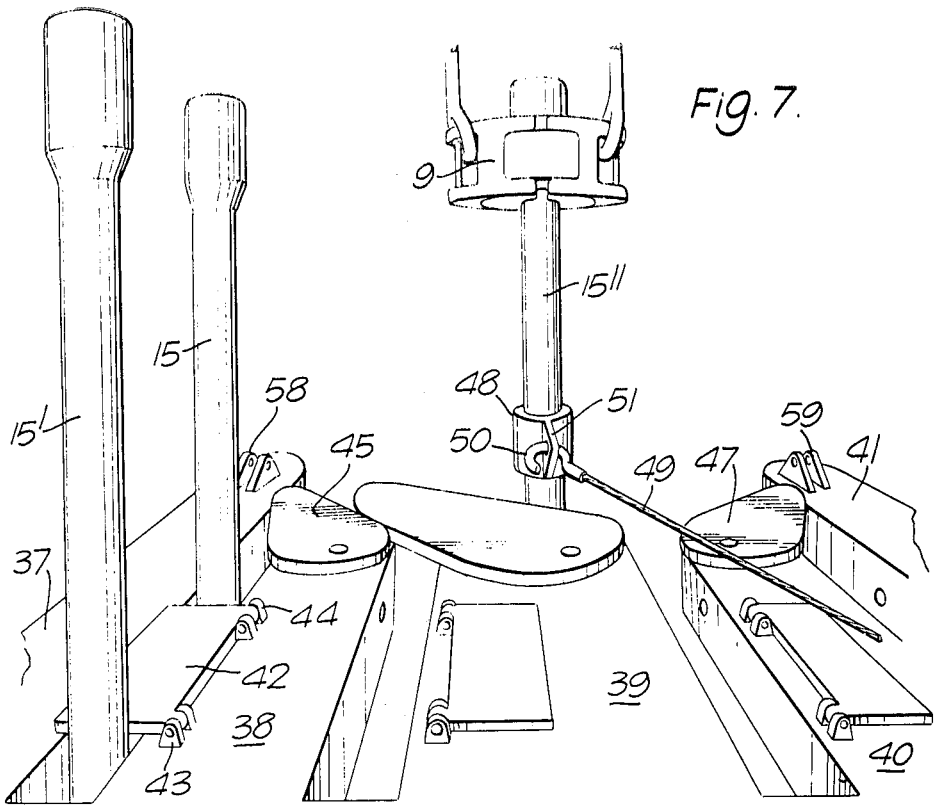
Figure 8:
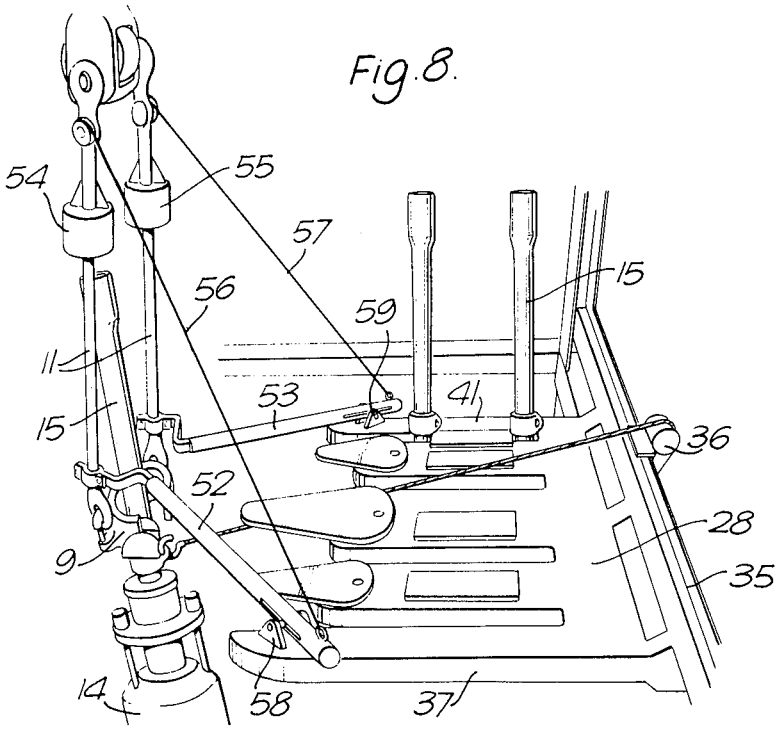
Figure 9:
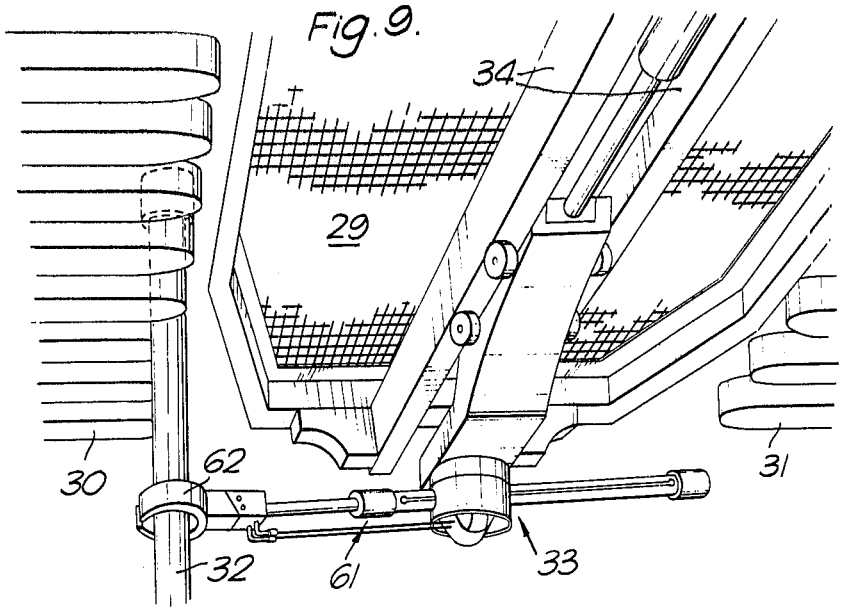
Figure 10:
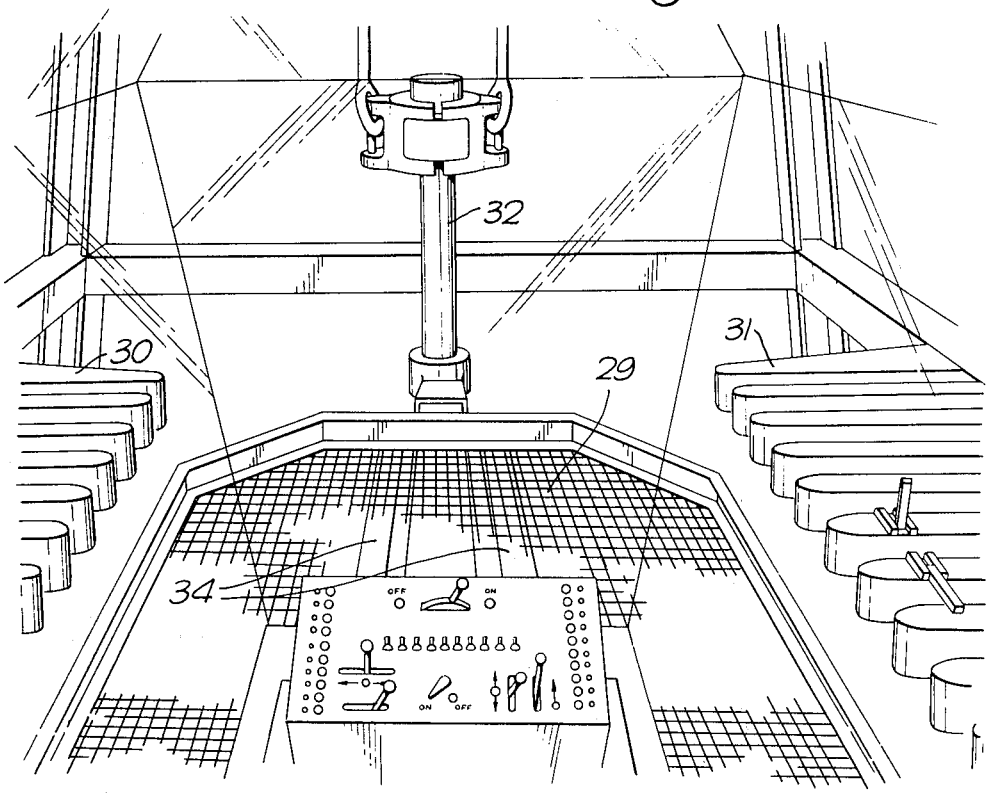
Figure 11:
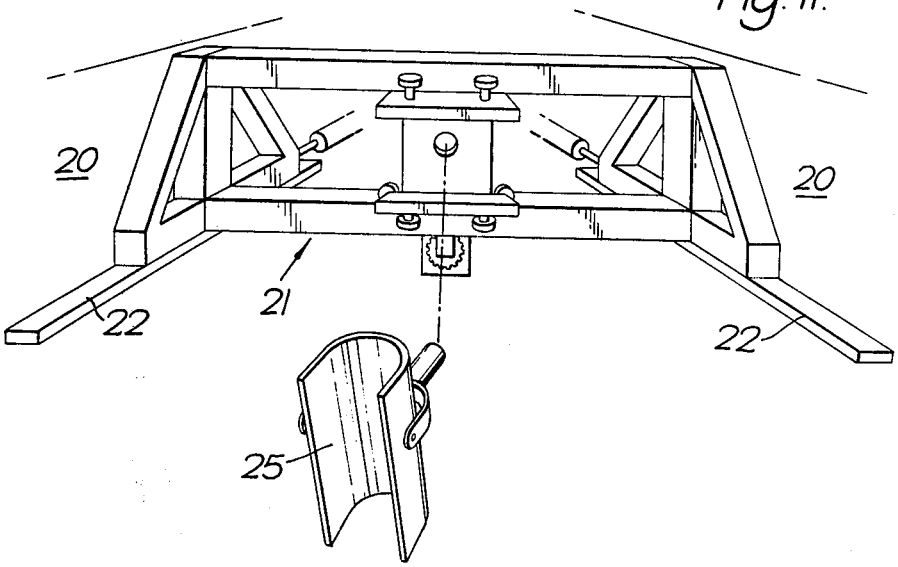
Figure 12:
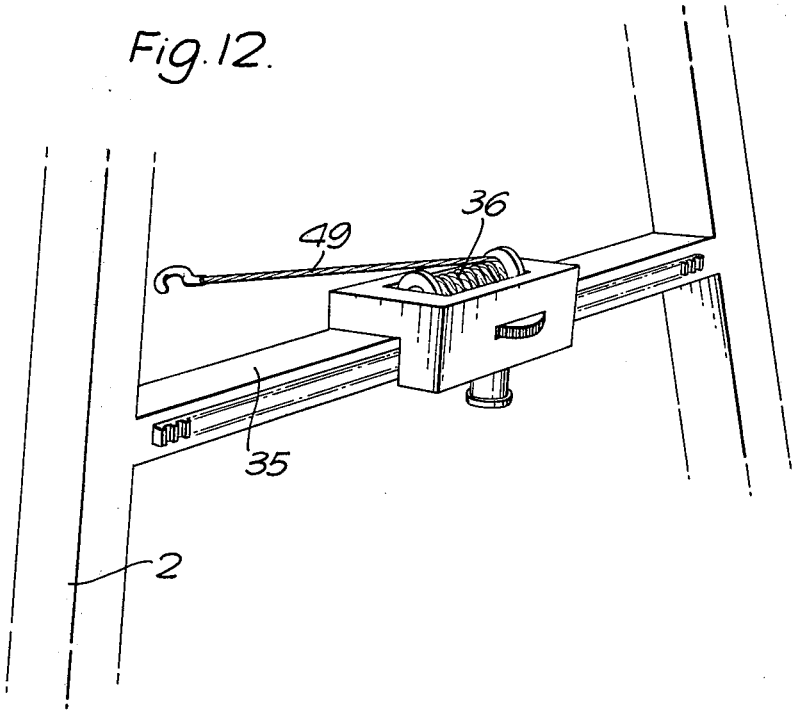

FIG. 5 shows a diagrammatical view in perspective of the drill floor in the area by the rotary table, FIG. 6 shows a diagrammatical view in perspective of the area in FIG. 5, seen from another angle, FIG. 7 shows a diagrammatical view in perspective of the riser pipe finger board in the drilling derrick, FIG. 8 shows a diagrammatical view in perspective of the area in FIG. 7, seen from another angle and with guide arms which are hinged to the elevator links, FIG. 9 shows a diagrammatical view in perspective of a derrick manipulator for drill-pipe stands seen from the underneath of the monkey board, FIG. 10 shows a diagrammatical view in perspective of the drilling derrick operator's console on the monkey board, with finger boards for storage of drill-pipe stands, FIG. 11 shows a diagrammatical view in perspective of a manipulator located beside the rotary table, and FIG. 12 shows a diagrammatical view in perspective of a winch trolley cart used for the insertion and extracting of the riser pipe's handling subs in the riser pipe finger board.

Figure 1:
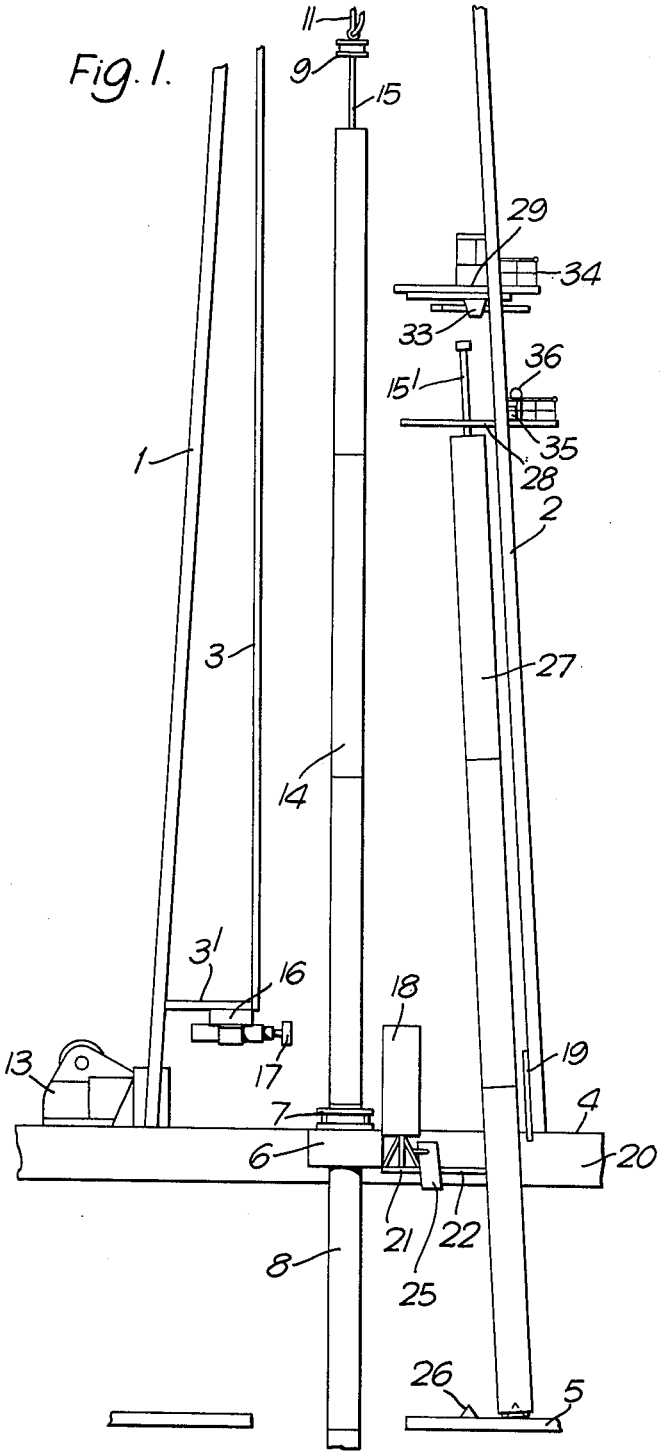
FIG. 1 shows a diagrammatical side view of a drilling derrick on a platform, with equipment for handling and racking riser pipe stands, one of which is depicted in an elevator.

In FIG. 1 a drilling derrick is diagrammatically shown, represented mainly by the corner posts 1 and 2 and the track 3. The track 3 is stiffened at the bottom against the derrick by means of a horizontal brace 4, but apart from this the brace and other constructional details are omitted in order to simplify the survey of the equipment in the drilling derrick.

The drilling derrick is monted on a drill floor 4. Under this is a so-called cellar deck 5. In the drilling floor 4 is a rotary table 6. On the rotary table is located in this case a so-called spider 7 for use in connection with the riser pipe 8 which extends down into the water toward the bottom of the sea. As can be seen, the drill floor and the cellar deck constitute parts of a platform which is intended for drilling and/or production of oil wells on the bottom of the sea. This platform is not shown. The platform may also in some cases be a drilling vessel.

An elevator 9 hangs in a block 10 in elevator links 11. The block 10 is the travelling block in a pulley system, where the wires are indicated by 12. The wire goes to the winch 13 on the drill floor 4 (see FIG. 4). The elevator and the attached lifting equipment are components known per se and hence need no further explanation.

A riser pipe length 14 hanges with its handling sub 15 in the elevator 9. The riser pipe stand 14 consists as shown of riser pipe sections which are coupled together and handled as a unit. The handling sub 15 is known per se, but is longer than is usual for riser pipe stands, in order to facilitate handling and racking according to the invention. Thus the new handling sub 15 has a length of approximately 2,5 m as opposed to the usual length which is less than 1 m.

In the lower cross-brace 4 for the track 3 is hung up a first manipulator 16, which by the putting on of a suitable head 17 can be used for both drill pipes as well as riser pipes. This manipulator is used to displace the lower end of the drill-pipe and riser pipe stands respectively out from the position in the centre line of the derrick, i.e. above the rotary table.

In an opening in the drill floor 4, which opening can be covered by doors 18, 19 and be limited sideways by two sturdy rotary beams 20 (only one is shown), another manipulator 21 is located. This second manipulator 21 serves to move a stand of riser pipes, and can move toward the right in FIG. 1, on rails 22 mounted on the rotary beams 20. This second manipulator 21 consists mainly of a traverse 23 in which runs a trolley 24 equipped with a handling head 25 for the riser pipe stand (FIG. 11).

On the cellar deck 5 are located a number of cones 26, corresponding to the number of riser pipe stands to be stored in the drilling derrick. During storage the riser pipe stands 14, 27 are positioned on these cones, so that the lower ends of the riser pipe stands are secured against displacement.

At a suitable distance above the drilling floor 4 is located a riser pipe fingerboard 28 in the derrick. This platform is equipped with a track intended for taking up and securing the handling extensions of the riser pipes (FIG. 7).

Figure 4:
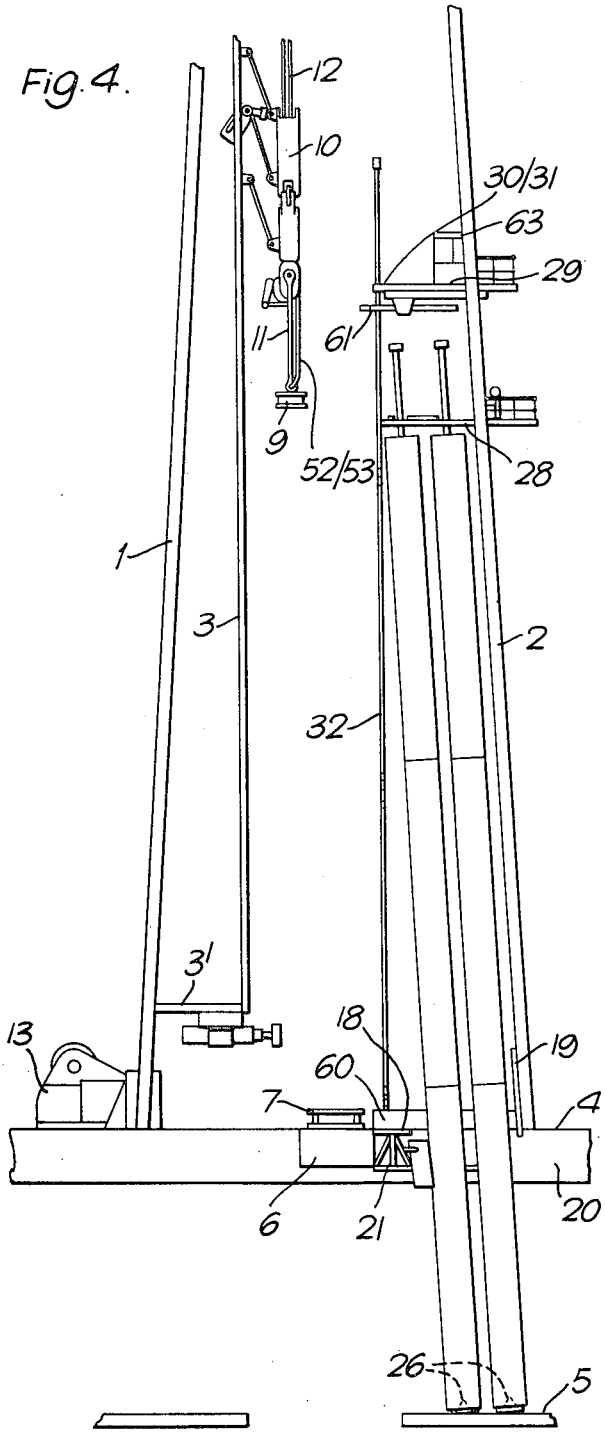
FIG. 4 is a diagrammatical side view similar to FIG. 1, but depicting the positioning of the riser pipe stand in the rack.

Above the riser pipe-fingerboard 28 is the so-called monkey-board 29 mounted in the drilling derrick. On each side of the monkey-board 29 are located fingerboards 30, 31 intended for taking up and securing the upper ends of the drill-pipe stands which are stored vertically in the drilling derrick. In FIG. 4 such a stand of drill pipes is drawn in and marked with the reference number 32. The finger-boards 30 and 31 are known per se. In rails 34 under the monkeyboard 29 is mounted a derrick manipulator 33 which is used when racking the drill pipe stands.

At the height of the riser pipe finger-board 28, approximately 1 m above the latter is located in the one side of the derrick a horizontal girt 35 on which is mounted a winch cart 36 (FIG. 12).

The general manner of operation for the device according to the invention can be explained more in detail, with special reference to FIGS. 1–4 which show four stages of the handling and racking of riser pipe stands in the drilling derrick. In FIG. 1 a riser pipe stand 27 is shown racked in the drilling derrick. The riser pipe stand 27 is placed on a cone 26 on the cellar deck 5 and is with its handling sub 15′ taken up and locked firmly in the riser pipe fingerboard 28. For a closer understanding of the taking up and securing in the fingerboard 28 see particularly FIG. 7.

As can be seen in FIG. 7, the finger-board 28 consists mainly of five extending fingers 37, 38, 39, 40 and 41. The two outside fingers 37 and 41 are longer than the three middle fingers 38, 39, 40 and extend consequently further into the drilling derrick from the side of the drilling derrick. Between the individual fingers are formed as shown openings in which the handling subs 15, 15′ of the riser pipes can be led in and locked. In its most simple form the lock consists of a flap 42 which is mounted on hinges at 43, 44 on a finger 38 and which when in swung out position covers over the track or opening between the fingers 37 and 38. The handling sub 15′ is thereby locked. The handling sub 15 furthest out can be locked by means of a suitable locking member, not shown, e.g. a bolt which is pushed into place over the opening between the fingers 37, 38.

The three middle fingers 38, 39, 40 have at the ends finger tips 45, 46 and 47 which are pivotally mounted. These finger tips have the rounded triangular form shown and can be swung in the platform plane, i.e. around vertical axes, by means of working cylinders, not shown, which are preferably located on the under side of each finger. In this way the individual finger tips 45, 46 and 47 can for example be swung to the position shown in FIG. 7 where the finger tips 46 and 47 form a V-shaped opening which serves to guide the riser pipe's handling sub 15″ into the opening or track between fingers 39, 40. The handling sub and thereby the riser pipe stand hand in the elevator 9 and are placed by means of the elevator onto the cone 26 on the cellar deck 5 which corresponds to the innermost position in the track between fingers 39 and 40. A collar 48 is put on the handlings sub and a wire 49 from the winch 36 is hooked fast into an ear 51 on the collar 48 by means of a hook 50. By means of the winch 36 (FIG. 12, 3) the handling sub can be drawn into place in the track between fingers 39, 40.

Figure 2:
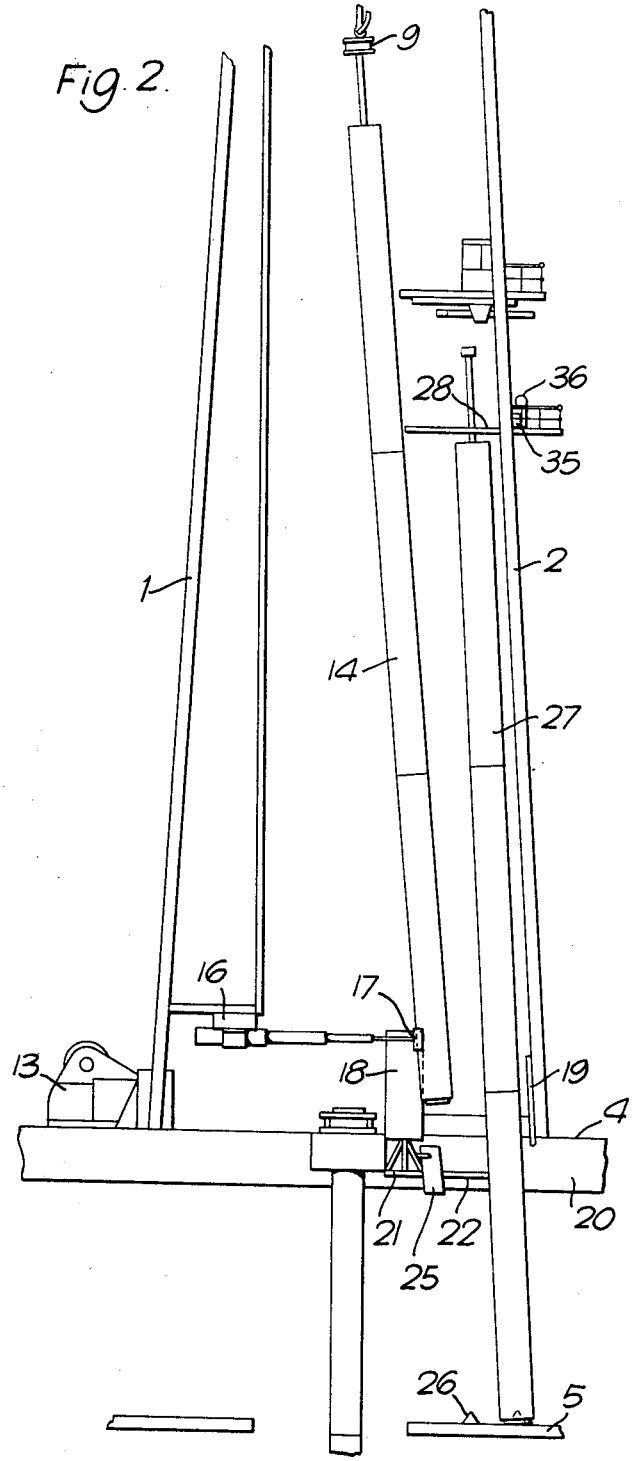
FIG. 2 is a diagrammatical side view similar to FIG. 1 but depicting the pushing of the lower end of the riser pipe stand in the direction of the racking area.
Figure 3:
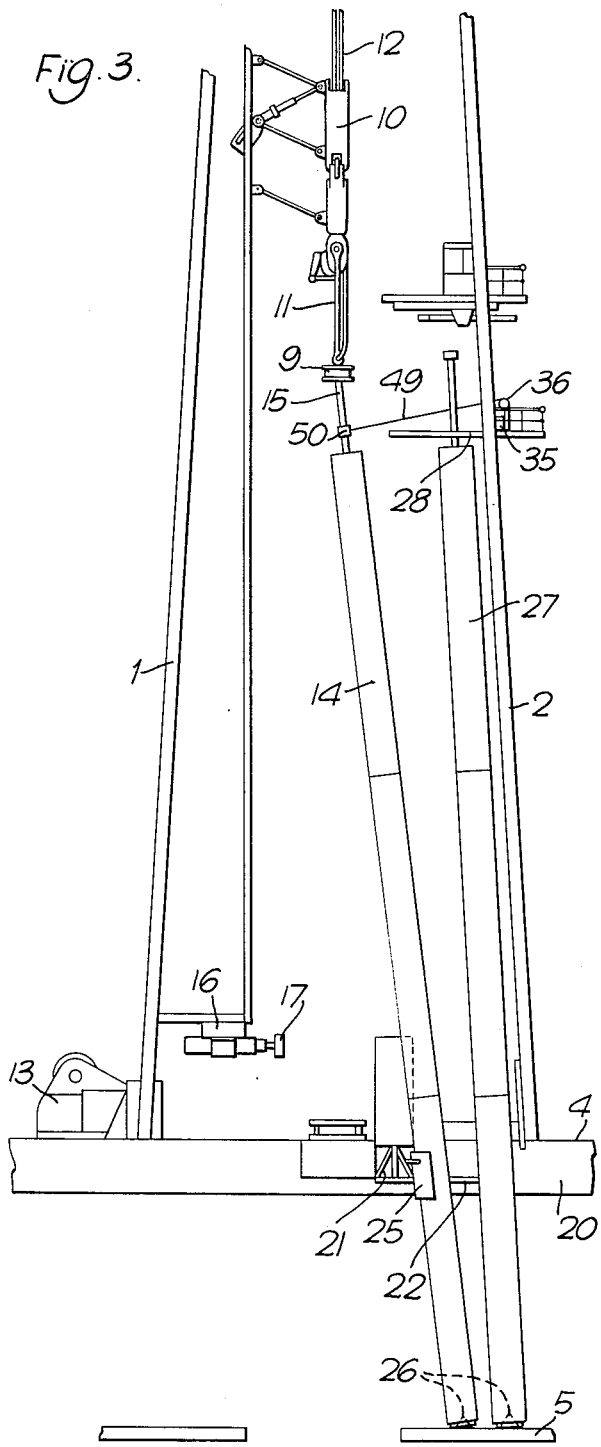
FIG. 3 is a diagrammatical side view similar to FIG. 1, but depicting the guiding of the riser pipe stand into place on a cone.

In FIG. 1 hangs a riser pipe stand 14 in the elevator 9 and it has just been disengaged from the rest of the riser pipe 8 which hangs in the spider 7. A floor door of floor member 18 is swung up, so that the driller can see the racking area (the cones 26) on the cellar deck 5, and can also see the second manipulator 21, 25. By means of the elevator 9 the riser pipe stand 14 is lifted free from the spider 7 and with the first manipulator 16, 17 the lower end of the riser pipe stand is pushed in the direction of the racking area as shown in FIG. 2. The riser pipe stand 14 is then lowered with the elevator 9 in such a way that the second manipulator 21, 25 makes contact with the lower part of the riser pipe stand and by means of this manipulator the riser pipe stand 14 is guided into place on the cone 26, see FIG. 3. The first manipulator 16, 17 can be drawn back as soon as the second manipulator 21, 25 has taken over. The wire 49 from the winch 36 is fastened to the riser pipe's handling sub 15 (FIG. 3, see also FIG. 7) and with the winch 36 the riser pipe stand 14 can then be drawn into place in the finger-board 28, after the elevator 9 first is disengaged. The handling sub is locked in place in the finger-board and the wire 49 is detached and hung away or made ready for fetching the next riser pipe stand. After the riser pipe stand is put in place in the rack the door 18 can be lowered again, so that there is an area of floor to walk on around the rotary table 6 (FIG. 4). When the riser pipe stands are not racked, the doors 19 can be lowered, so that there is a complete floor in this area. It is an advantage to have four doors 19 side by side, when room is set aside as in the embodiment for storing eight riser pipe stands, arranged in two rows with four riser pipe stands in each row. Each door covers then the racking area for two riser pipe stands.

The removal of riser pipe stands from the rack takes place in working stages in opposite order to that which is previoulsy described. In addition, nevertheless, the guide arms 52, 53 are used which are hung up on the elevator 9 (FIG. 8). These guide arms are pivotally mounted in the elevator links 11 and are held in a position parallel with the elevator links by means of counter weights 54, 55 which hang in wires 56, 57 connected to the free ends of the guide arms 52, 53. These guide arms will thus be swung up by the counter weights to the position shown in FIG. 4 as soon as they are released from engagement with the finger-board 28. When the arms are to be used, the drilling derrick operator has to draw the arms down and fasten them to the cam locks 58, 59. The cam locks are shaped in such a way that an upward or downward movement of the elevator will effect the releasing of the arms from the locking interaction with the finger-board, i.e. with its two outer fingers 37, 41.

All handling subs 15 will be caught between these two guide arms 52, 53 when they are brought into place. The arms are as shown shaped in such a way that they guide the respective handling sub straight into the open elevator. The elevator opens and locks automatically and can be opened by means of compressed air. As previously mentioned, the elevator is of a construction known per se. During the transfer from the finger-board 28 to the elevator 9, the wire 49 is hooked on, in the same manner as during insertion of the riser pipes, handling sub into the finger-board, and the movement in toward the elevator is braked by means of the winch 36.

The placing of the riser pipe set back area in the drilling derrick entails that the racking device for the drill pipes, which are also to be racked in the drilling derrick must be shaped accordingly, i.e. adjusted to the altered space conditions. On the drill floor is designed a set back platform for the stands of drill pipe on each side of the opening between the rotary beams 20, which opening as previously mentioned, when the riser pipe set back area is not in use, can be closed by the doors 19 in addition to the door 18. Such a platform is in FIG. 1–4 marked by reference number 60. In FIG. 4 as previously mentioned there is drawn in a drill pipe stand 32 which is placed on the set back platform 60 on the drill pipe stand 32 which is placed on the set back platform 60 on the drill floor 4, and in the derrick is caught and locked in a finger-board 30, 31 (see FIGS. 9 and 10). These finger-boards are arranged one on each side of the monkey board 29. Such fingerboards and their embodiments are known per se and therefore need no further explanation either with respect to construction or operation.

The monkey board 29 is constructed large enough to cover the riser set back, so that in this manner riser pipes and drill pipes are prevented from interfering with one another. Under the monkeyboard 29 a derrick manipulator 33 is mounted on rails 34 and which serves to manipulate the drill pipe stands during insertion and removal from the set back area. In addition the manipulator 16 is used. The handling of the drill pipe stands takes place therefore by means of the elevator and the manipulators 16, 33 in a way which closely follows the otherwise usual manual handling.

The manipulator 16 which is termed as the first manipulator, has a telescopic arm which when fully displaced, can cover a distance of approximately 8 mm. The arm extends approximately 6, 5 m and is driven by a 140 HP hydraulic motor over a toothed bar and chain-wheel arrangement which moves each telescopic segment the same distance. That is to say that all the telescope segments move simultaneously with the exception of the last segment. This is driven by a hydraulick cylinder in order to obtain a more exact control movement.

In order to simulate manual operation, and substantially achieve the same speed as with manual racking, the racking arm in a practical example is constructed in such a way that it moves the previously mentioned distance of approximately 6, 5 m in the course of 6 seconds. Just before the arm is fully swung out a brake valve is coupled in, so that the arm is braked down gently, whereby the strain on the gear wheel and chain is limited. This means that the manipulator moves relatively quickly forward in the proximity of the measuring area, and then the hydraulic cylinder is used to complete the final sliding out movement and to make possible and exact placing of the head 17.

The derrick manipulator 33 under the monkey board 29 is such that its arm 61 can be driven outwards to grip hold of the drill pipe 32. When the elevator 9 is released, the arm 61 can be swung 90°. In practice, this happens so quickly that it takes approximately 3 seconds for the drill pipe to come clear of the drill string compensator. As soon as the aforementioned 90° turning movement is completed, the drill stand can be moved outwards toward the derrick side, into a correct position outside a selected opening in the finger-board 30 or 31. When the manipulator moves back, an indicator-reflector will give the position for each finger opening. Another set of reflectors registers which finger opening is in use. When two reflector signals are given, the manipulator arm will be in a position where it can slide the drill pipe stand into place. When this has taken place, the drill pipe stand is locked in the fingerboard, the gripping head 62 is freed, and the arm 61 can be drawn back. The manipulator arm 61, when it is not in use, can be brought into a position where it is not in the way of the block 10 and the elevator 9. For safety's sake, the head 62 is mounted in such a way on the arm 61 that should the elevator fall down and hit the head 62, a shear-pin will break off and the head 62 will then swing down and make room for the lifting equipment, including the hook and drillstring compensator.

It is an advantage if the drilling derrick operator sits in a closed cabin 63. FIG. 10 shows a view in perspective taken from the inside of this cabin. By placing the operator in a closed cabin, the otherwise necessary protection walls around the drilling derrick at this level of height can be eliminated. As all operations can be controlled from this cabin, the operator does not therefore need to leave the cabin. The hydraulic and pneumatic circuits are made as simple as possible. Accordingly, four hydraulic valve levers are sufficient for controlling the movements of the derrick manipulator. The air pressure system is constructed in such a way that air pressure can only be supplied to one finger at a time in the drill pipe finger-board, so that in this way it is sufficient with the same number of control buttons as the number of locking members on a single finger.

The new handling and racking system, including both the handling and racking of riser pipes and drill pipes, operates in a manner which closely resembles the familiar manual methods. This is an advantage because it is possible when training a crew to connect the training to previously known and familiar technique, so that the training is simplified. At the same time, the new system results in more rapid handling. Independent of the time savings, working conditions are also made easier for the crew.

Having described our invention, we claim:

1. Device for handling and racking riser pipes in a driling derrick on a platform for drilling and/or production of oil wells on the bottom of the sea, said platform/-drilling derrick comprising a drill floor and a cellar deck, characterized in that said device comprises a set back platform on the cellar deck for vertical racking of riser pipe stands in the drilling derrick, a first manipulator for displacement of a riser pipe stand's lower end between a first position near the centre line of the drilling derrick and another position outside the center line, a second manipulator for displacement of a riser pipe stand's lower end between the aforementioned other position and a position above the set back position on the cellar deck, an elevator in the drilling derrick for raising and lowering riser pipe stands, a finger-board in the drilling derrick intended for taking up handling subs on the riser pipe stands, locking members on the finger-board for securing the handling subs in the finger-board, a third manipulator for guiding and moving respectively a handling sub between a position near the centre line of the drilling derrick, in which position the handling sub can be coupled with the elevator, and a set back position in the finger-board.

2. Device according to claim 1, characterized in that the first manipulator is a combined drill pipe and riser pipe manipulator.

3. Device according to claim 1, characterized in that the second manipulator is located under the drill floor.

4. Device according to claim 3, characterized in that the second manipulator is constructed as a traverse between two sturdy rotary beams in the drill floor, said traverse being movably mounted on rails on the rotary beams, and that a trolley which carries a manipulator head for a riser pipe stand is driveably placed on the traverse.

5. Device according to claim 3, characterized by trap doors, which can be swung up in the drilling floor above the set back platform on the cellar deck.

6. Device according to claim 5, characterized in that a control console for the second manipulator is placed on the underside of that one of the trap doors which can be swung up and which is nearest the rotary table (FIGS. 5 and 6).

7. Device according to claim 1, characterized in that the third manipulator comprises a winch which is transversely movable in the drilling derrick, guide arms pivotally mounted in the links of the elevator, and intended for disengageable interaction with the finger-board, as well as pivotally mounted guiding members on the finger-board for guiding the handling subs in and out respectively of the spaces between the fingers of the board.

8. Device according to claim 7, characterized in that the guide arms are counter balanced so that when they are released from interaction with the riser pipe finger-board, they swing up to a position parallel with the elevator links.

9. Device according to claim 1, characterized in that the first manipulator has exchangeable guiding heads.

10. Device according to claim 1, characterized in that the platform on the cellar deck has upwardly projecting guide cones for cooperation with the bottom ends of the riser pipe stands, when in racked position.

11. Device according to claim 1, characterized in that the manipulator head of the first manipulator is shaped like a vertical half cylinder which is pivotally mounted over the centre of gravity, so that it normally hangs vertically.

12. Device for handling and racking drill pipes in a drilling derrick, in connection with racking of riser pipe stands according to claim 1, characterized in that said device comprises a first manipulator for the displacement of a drill pipe stand's lower end between a first position near the centre line of the drilling derrick, and a position above a set back position on the drilling floor, an elevator in the drilling derrick for raising and lowering stands of drill pipes, a drill pipe finger-board for catching up the upper ends of the drill pipe stands, locking members on the drill pipe finger-board for securing the stands of drill pipe in the drill fingerboard, and a derrick manipulator for gripping and moving of a drill pipe stand's upper end between a position near the centre line of the drilling derrick, in which position the drill pipe stand can be coupled with the elevator, and a set back position in the drill pipe finger-board.

13. Device according to claim 12, characterized in that the derrick manipulator mainly comprises cart which is driveably mounted on rails under a monkey-board, and which carries an arm which can be slid in and out with a gripping head for the drill pipe.

* * * * *